US006234157B1

(12) United States Patent
Parks

(10) Patent No.: US 6,234,157 B1
(45) Date of Patent: May 22, 2001

(54) PAINTBALL GUN LOADER SPEED COLLAR

(75) Inventor: Gerald R. Parks, Chula Vista, CA (US)

(73) Assignee: John R. Gregory

( * ) Notice: Subject to any disclaimer, the term of this patent is extended or adjusted under 35 U.S.C. 154(b) by 0 days.

(21) Appl. No.: 09/391,897

(22) Filed: Sep. 7, 1999

Related U.S. Application Data

(63) Continuation-in-part of application No. 09/149,720, filed on Sep. 8, 1998, now Pat. No. 6,015,058.

(51) Int. Cl.[7] ..... F41B 11/02
(52) U.S. Cl. ..... 124/45; 124/49; 124/50
(58) Field of Search ..... 124/45, 49, 50

(56) References Cited

U.S. PATENT DOCUMENTS 1,955,559 * 4/1934 Narrow ..... 124/45 X
3,263,664 * 8/1966 Bauer et al. ..... 124/50 X
3,996,916 * 12/1976 Koehn et al. ..... 124/45 X
4,020,974 * 5/1977 Bauer et al. ..... 124/50 X
4,564,125 * 1/1986 Esslinger ..... 124/45 X
4,723,531 * 2/1988 Hampton ..... 124/45
4,967,723 * 11/1990 Cutrell ..... 124/50
5,166,457 * 11/1992 Lorenzetti ..... 124/49 X
5,687,867 * 11/1997 Lamoureux ..... 215/303
5,809,983 * 9/1998 Stoneking ..... 124/45 X
6,055,975 * 5/2000 Gallagher et al. ..... 124/50

* cited by examiner

*Primary Examiner*—John A. Ricci
(74) *Attorney, Agent, or Firm*—Henri J. A. Charmasson; John D. Buchaca

(57) ABSTRACT

A container which can be held and opened by one hand has a dome-shaped cap formed by a series of adjacent, contiguous and ogee-shaped segments resiliently held together by an elastic ring. When the cap is forced down over the opening rim of the vessel, the ogee-shaped segments separate to expose the vessel opening. A similar cap mounted in the inverse direction in the inlet of a paintball-shooting gun magazine opens when contacted by the rim of a paintball container from which the magazine is being reloaded.

8 Claims, 4 Drawing Sheets

FIG. 1
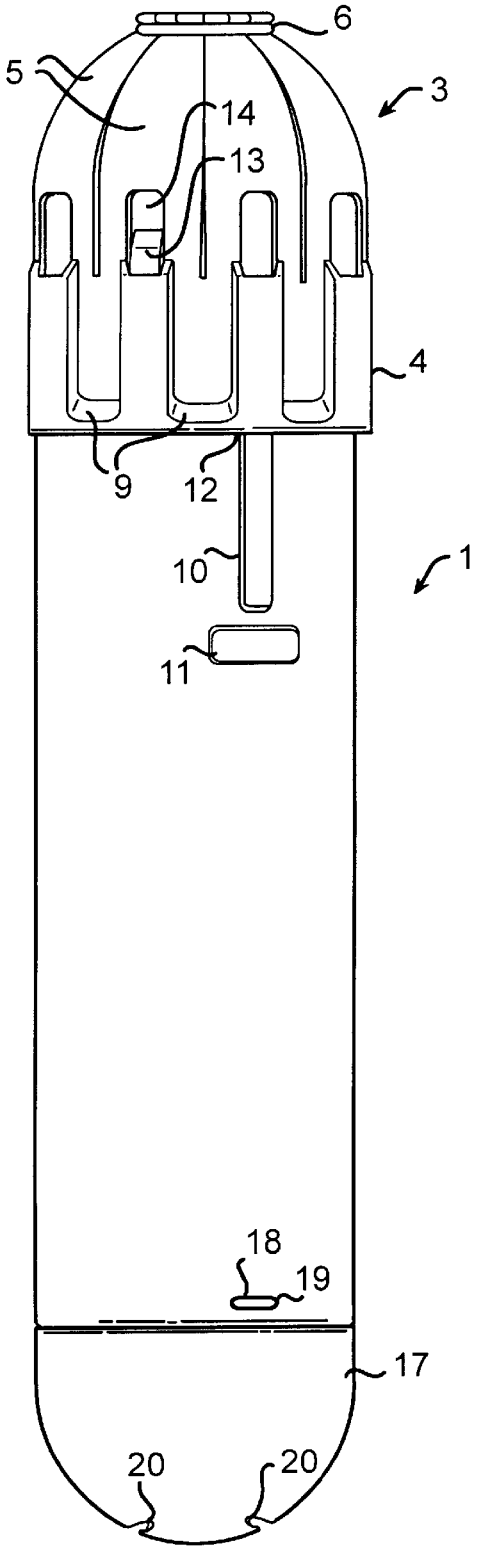
FIG. 2
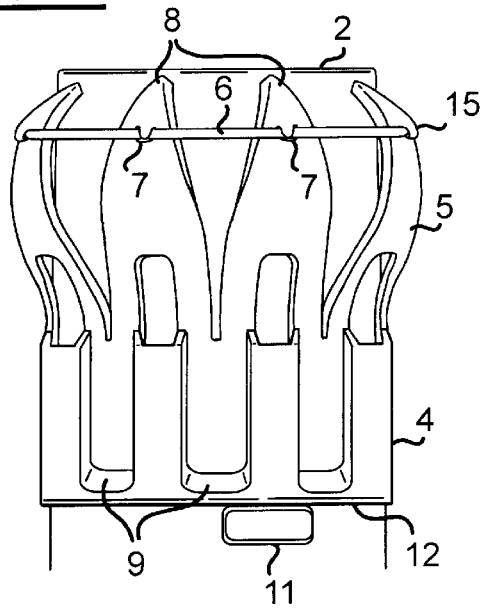
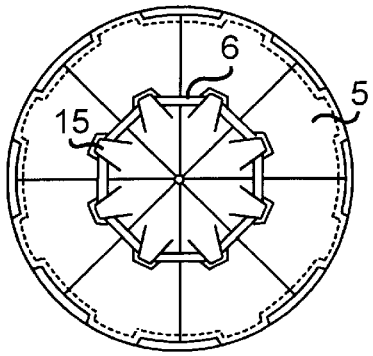
FIG. 3
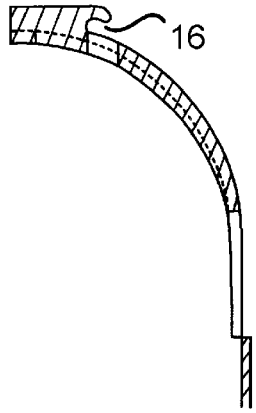
FIG. 4

PAINTBALL GUN LOADER SPEED COLLAR

PRIOR APPLICATION

This application is a continuation-in-part of application Ser. No. 09/149,720 filed Sep. 8, 1998, now U.S. Pat. No. 6,015,058.

FIELD OF THE INVENTION

This invention relates to paintball gun magazines and more particularly to reloading mechanisms therefor.

BACKGROUND OF THE INVENTION

In many life situations, it is advantageous to use containers that can be opened and shut by movement of the thumb of the very hand that holds the container. One can think of the situation where one hand is busy stirring a preparation and small amount of various other products may have to be added to that preparation such as in a kitchen or laboratory environment. In the old days, a warrior using a muzzle-loaded rifle would reach for a powder cartridge with one hand while holding the rifle with the other. He would then rip the top of the carton cartridge with his teeth before pouring its contents into the muzzle. A similar situation is encountered today when participants in paintball games must reload their weapon with a new supply of paintballs. Prior art paintball containers have an hinged top which still requires to be opened with two hands or use of the mouth.

This invention results from efforts to provide a more convenient form of paintball gun loading containers.

SUMMARY OF THE INVENTION

The principal and secondary objects of this invention are to provide a simple and economical type of plastic container that can be held with one hand and opened then closed by movement of the thumb of that same hand, and without offering any interference across the opening of the container.

Another object of this invention is to allow a participant in a paintball shooting game to single-handedly reload the magazine of his paintball gun, and to eliminate a need for a cover in the inlet of such magazine.

These and other valuable objects are achieved by a dome-shaped cap which is formed of a series of adjacent and contiguous ogee-shaped segments that come together under the action of an elastic ring to form a dome. The segments are mounted on an annular ring that slips over the cylindrical opening of the container. By pushing the annular ring down, the rim of the container causes the ogee-shaped segment to separate and expose the opening without any interference.

In a collar mounted over the inlet of a paintball gun magazine, a similar but inverted cap acts as a check-valve to prevent paintballs from spilling out of the magazine, the petal-shaped segments of the cap spread apart when contacted and pushed by the rim of the container from which the magazine is reloaded. This container may be of the type described above, or any other container with a rim commensurate with the collar.

BRIEF DESCRIPTION OF THE DRAWING

FIG. 1 is a front elevational view of a paintball container having a cap according to the invention;

FIG. 2 is a elevational view of the cap in an open position;

FIG. 3 is a top plan view of a cap in the closed position;

FIG. 4 is a cross-sectional view of an alternate embodiment of the cap;

DESCRIPTION OF THE PREFERRED EMBODIMENT OF THE INVENTION

Figure 5:
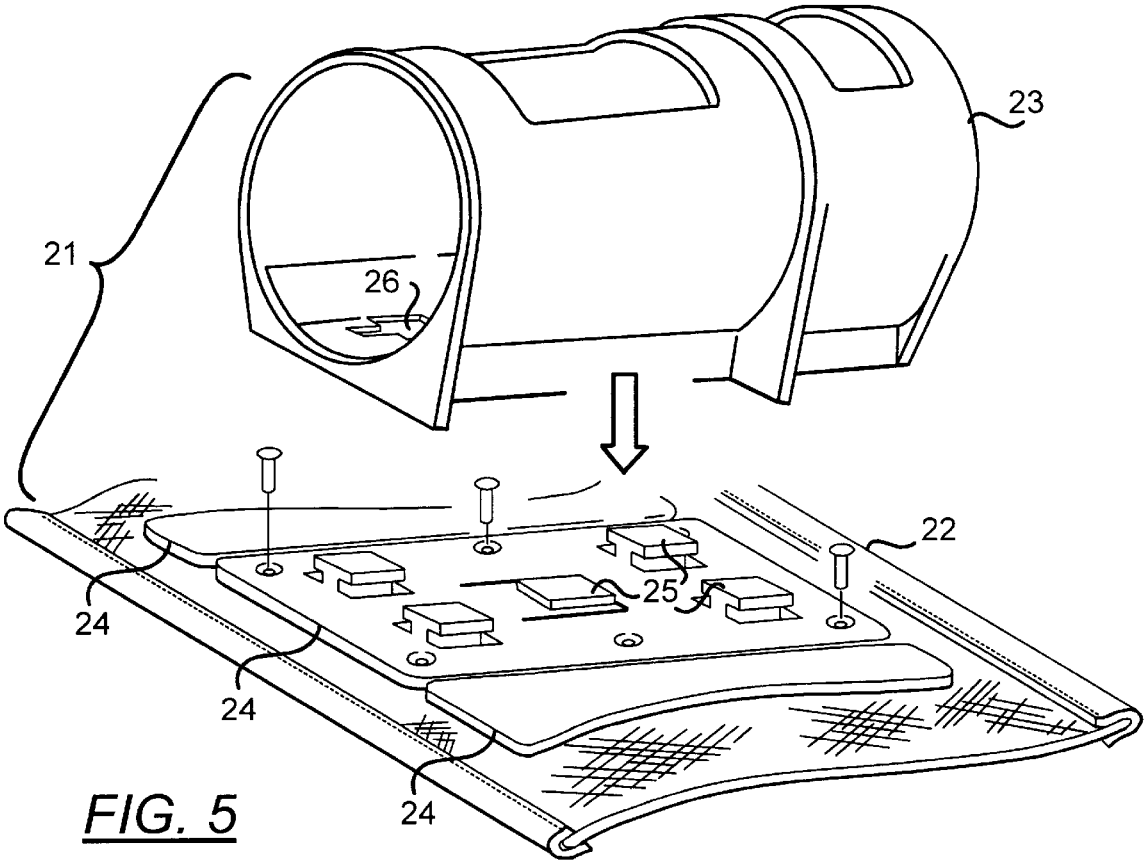
FIG. 5 is an exploded view of a holster for the paintball container.
Figure 6:
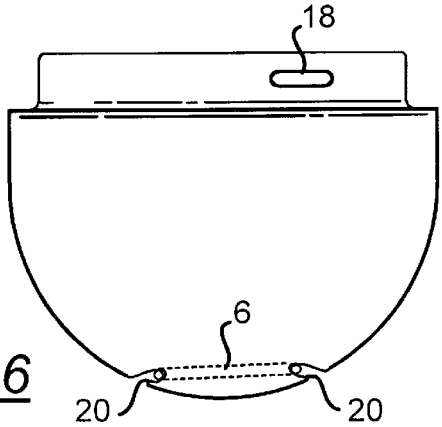
FIG. 6 is a view of a bottom cap.

Referring now to the drawing, there is shown a container 1 having a cylindrical opening rim 2 closed by a dome-shaped cap 3. It should be noted that the invention is adaptable to any container having a cylindrical pouring spout. The cap comprises an annular ring 4 which is dimensioned to intimately slip over the rim 2. Projecting from the upper ridge of the ring, are a series of contiguously adjacent ogee-shaped segments 5 which are biased toward one another by an elastic ring 6 captured in recesses 7 in the upper portion of each segment. When the apexes 8 of the segments are brought together, a closed dome is formed over the container rim. Alternatively the segments 5 may be made of a resiliently flexible material and molded into their arcuate closing positions so that they automatically draw toward one another when not forced back by the opening rim 2. A series of indentations 9 practiced over the outer surface of the annular ring facilitates pushing down the ring over the neck of the container so that the ogee-shaped segments are forced to separate from one another to expose the opening rim 2 without any interference. A longitudinal slide bar 10 is provided just below the opening rim that nest in a corresponding groove cut into the inner wall of the annular ring so as to prevent the cap from spinning during operation. The maximum downward excursion of the sliding ring is limited by a stop bar 11 against which the lower edge 12 of the annular ring comes to rest. The maximum upward excursion of the cap is set by a stop nib 13 projecting from the outer wall of the rim through a small depression or opening 14 in the lower section of one or more of the ogee-shaped segments. It should be noted that due to the shape and position of the stop nib 13, it disengages easily from the opening 14 when the annular ring is pushed down. The recesses 7 into which the elastic ring is captured are formed by a simple U-shape cut into each segment that nests a section of the ring under the tongue segment 15 thus formed. Illustrated in FIG. 4, is an alternate version of the cap in which the recesses 16 for the elastic ring are formed in the molding of the cap segments. The opposite end of the container is sealed by a removable hemispherical cap 17 which is held in place by a nib 18 extending from the container outer rim wall of the bottom cap into an opening 19 along the lower edge of the container. On the apex surface of the bottom cap 17, a pair of asymmetrical and diametrically opposed projections 19 and 20 are conveniently provided to hold a number of spare elastic rings which may be constituted by appropriately sized O-ring seals.

Illustrated in FIG. 5 is a holster 21 adapted for seating and holding the paintball container 1. The holster comprises a belt 22 to which a slightly tapering near-cylindrical receiver 23 shaped and dimensioned to nest a container 3 can be attached. A plaque 24 permanently riveted to the belt has a plurality of prongs 25 which are shaped and dimensioned to engage and slide into corresponding apertures 26 in the wall of the receiver. It should be noted that several plaques 24 can be riveted along the belt so that a user may carry a number of paintball containers.

Figure 7:
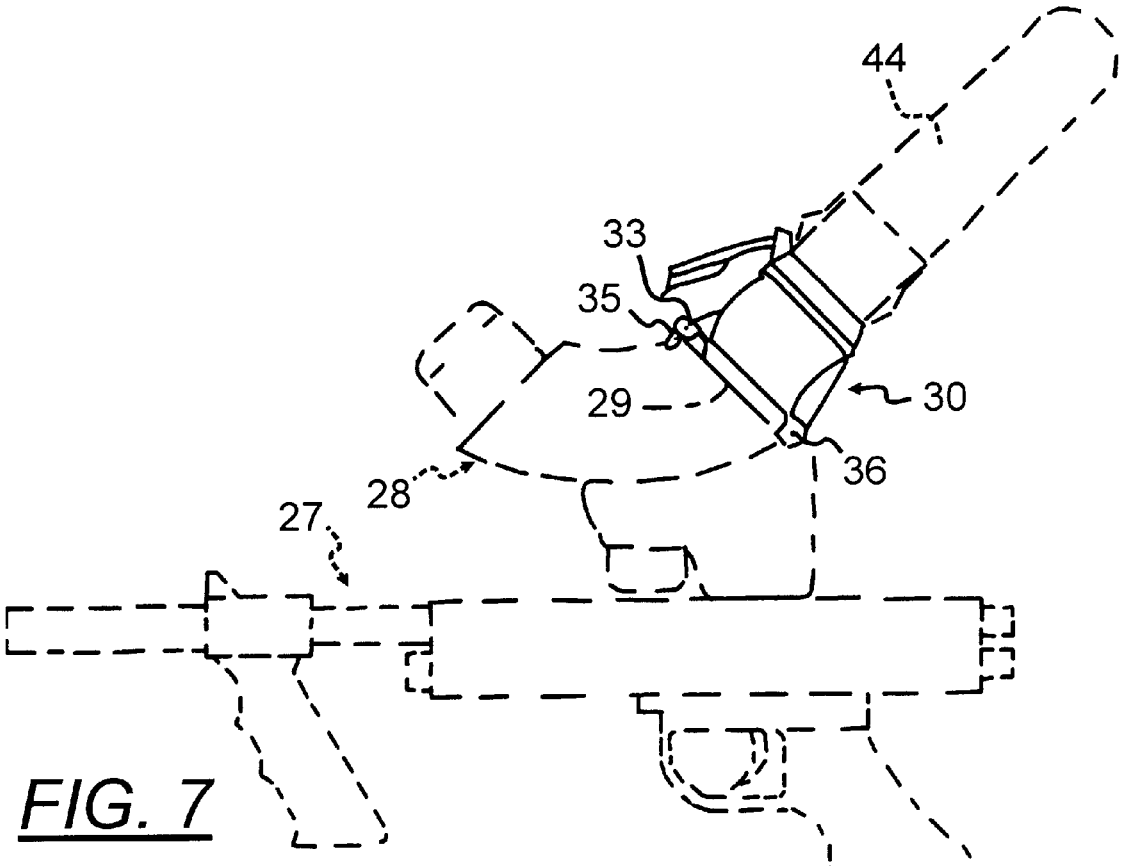
FIG. 7 is a side view of a paintball gun magazine equipped with the loader speed collar.
Figure 8:
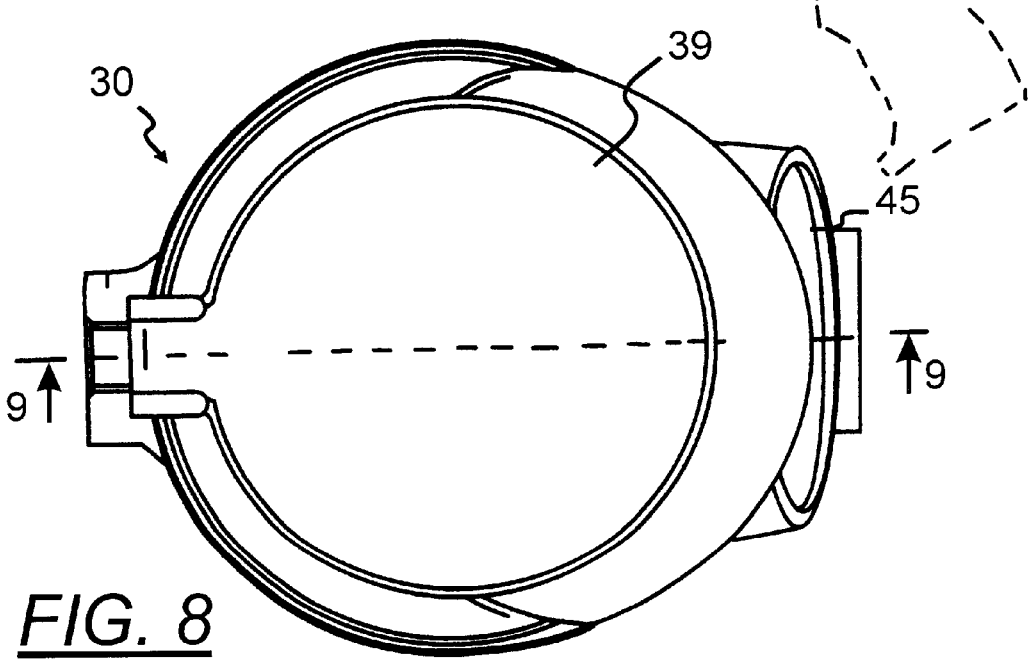
FIG. 8 is a top plan view of the collar.
Figure 9:
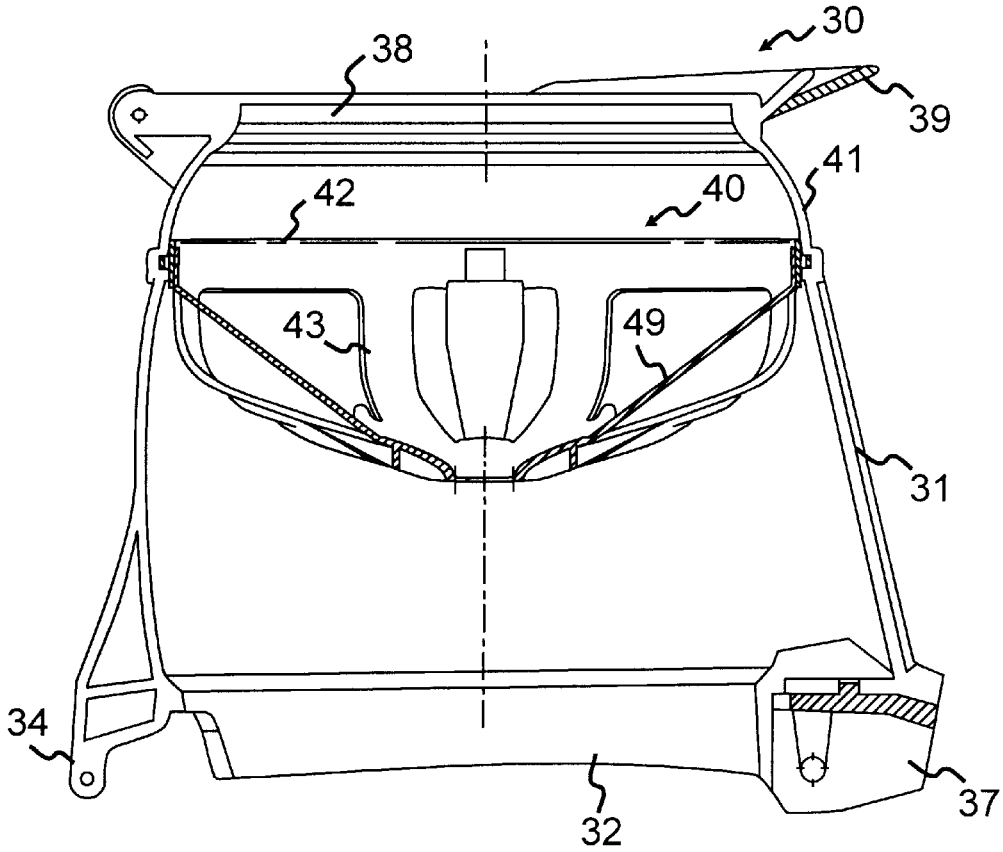
FIG. 9 is a cross-sectional view taken along line 9—9 of FIG. 8.

As illustrated in FIG. 7, a paintball-shooting gun 27 is usually equipped with a loader magazine 28 of the type disclosed in U.S. Pat. No. 5,282,454, which patent is hereby incorporated in this specification. This specification discloses a speed collar specifically designed to be mounted on a Model 6-8 of paintball gun loader available from Brass Eagle of Roger, Ark. The lid which normally seals the inlet 29 of the magazine has been removed and replaced by a speed collar 30, more specifically shown in FIGS. 8 and 9. The collar 30 comprises a substantially cylindrical enclosure 31 having open lower-end 32 configured to imitmately mate with the inlet 29 of the magazine. More specifically, the lower end matches the outline of the removed lid so that it can be secured to the magazine by a pin 33 passing through a gusset 34 and matching bearing 35 of the removed lid, and by another pin 36 passing through a pair of ears 37 and replacing a screw securing the two halves of the magazine enclosure. The circular aperture 38 at the upper end of the collar can be closed by a hinged lid 39 similar to the one removed from the inlet of the gun magazine.

A check valve 40 is mounted inside the enclosure 31 near its upper rim 41. The valve comprises a ring frame 42 from which a series of petal-shaped fingers 43 project in a radial and downwardly oblique direction. The fingers 43 are made of plastic or other resiliently flexible material.

When the rim at the end of a paintball container 44 is jammed into the upper end of the collar 30, the fingers 43 are forced to spread apart allowing the paintballs to fall into the magazine. When the paintball container is withdrawn the fingers retract to their closed position, and the paintballs inside the magazine and collar are prevented from popping out. The check valve 40 and preferably the entire collar are made from transparent material in order to provide an easy view of the magazine contents. A niche 45 is provided on the outer surface of the enclosure 31, and is shaped and dimensioned to house a game count-down clock, or other score counter or timepiece.

Figure 10:
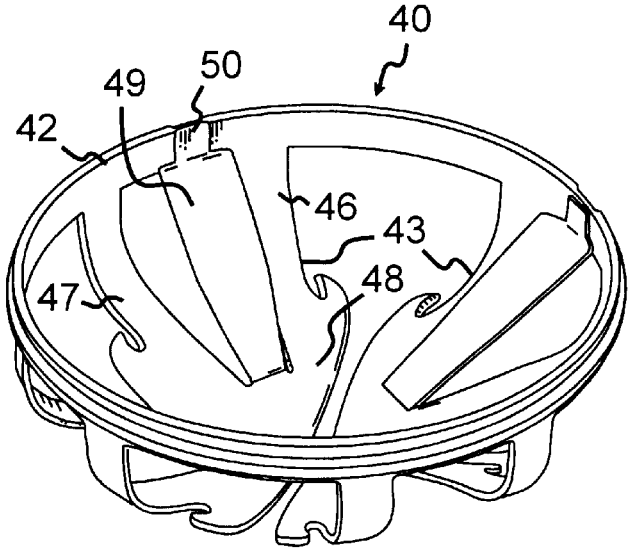
FIG. 10 is a perspective view of the check valve.

As illustrated in FIG. 10, each finger 43 of the check valve is made of two segments 46, 47 merging at their distal ends into an arrowhead-shaped tip 48. A leaf spring tab 49 is secured to the back of the arrowhead-shaped tip 48 and project upwardly and radially toward the ring frame 42. The upper end of the spring tab is secured to the ring frame by a clip 50. The spring tabs are manufactured integrally with the finger. When contacted by the rim of the paintball container 44, they provide an even and complete spreading of the fingers as well as a complete return of the fingers to their close position after the paintball container has been withdrawn.

While the preferred embodiments of the invention have been described, modifications can be made and other embodiments may be devised without departing from the spirit of the invention and the scope of the appended claims.

What is claimed is:

1. In a paintball gun in which a paintball magazine is refillable by dumping therein the contents of a paintball loader through a port in said magazine, the improvement which comprises:

an intermediary collar having a lower end securable to said port, an upper end, and a passageway therebetween of a given diameter;

a check valve across said passageway for preventing backward movement of paintballs from said lower end toward said upper end.

2. The improvement of claim 1, wherein said loader has an outlet and said upper end is shaped and dimensioned to mate with said outlet.

3. The improvement of claim 2, wherein said port comprises a lid hingedly connected to a rim thereof; and said collar lower end is shaped and dimensioned to be mounted hingedly over said port in lieu of said lid.

4. The improvement of claim 2, wherein said collar further comprises an outer wall surface shaped and dimensioned to mount a counter.

5.The improvement of claim 1, wherein said check valve comprises:

a ring having a diameter commensurate with said given diameter and a plurality of resiliently flexible fingers projecting therefrom in a radial and downwardly oblique direction toward the center of said passageway.

6. The improvement of claim 5, wherein said check valve is transparent.

7. The improvement of claim 5 wherein said loader includes an outlet shaped and dimensioned to extend into said passageway for contacting said fingers whereby said contacting causes said fingers to spread apart downwardly and allow passage of paintballs from the container into said magazine.

8. The improvement of claim 1, wherein said collar further comprises a lid hingedly secured to said upper end.

* * * * *